US008696226B2

(12) United States Patent
Hornfeck

(10) Patent No.: US 8,696,226 B2
(45) Date of Patent: Apr. 15, 2014

(54) ROTARY PENCIL

(75) Inventor: Stefan Hornfeck, Geroldsgrün (DE)

(73) Assignee: Faber-Castell AG, Stein (DE)

( * ) Notice: Subject to any disclaimer, the term of this patent is extended or adjusted under 35 U.S.C. 154(b) by 437 days.

(21) Appl. No.: 12/876,313

(22) Filed: Sep. 7, 2010

(65) Prior Publication Data

US 2011/0058887 A1 Mar. 10, 2011

(30) Foreign Application Priority Data

Sep. 4, 2009 (DE) ..... 10 2009 040 134
Dec. 23, 2009 (DE) ..... 10 2009 055 240

(51) Int. Cl.
*A45D 40/04* (2006.01)

(52) U.S. Cl.
USPC ..... 401/75; 401/68

(58) Field of Classification Search
USPC ..... 401/68–75
See application file for complete search history.

(56) References Cited

U.S. PATENT DOCUMENTS

| | | | | |
|---|---|---|---|---|
| 2,546,195 | A * | 3/1951 | Mellette | 401/69 |
| 5,547,300 | A * | 8/1996 | Powers | 401/68 |
| 5,549,404 | A * | 8/1996 | Kageyama et al. | 401/75 |
| 5,553,956 | A * | 9/1996 | Mitsuya et al. | 401/75 |
| 6,082,917 | A * | 7/2000 | Noguchi et al. | 401/75 |
| 6,149,331 | A * | 11/2000 | Raps et al. | 401/75 |
| 6,450,715 | B2 * | 9/2002 | Ohba | 401/78 |
| 6,588,957 | B2 * | 7/2003 | Ohba | 401/75 |
| 6,676,319 | B2 * | 1/2004 | Werhahn et al. | 401/72 |
| 6,769,826 | B2 * | 8/2004 | Ohba | 401/75 |
| 6,835,016 | B2 * | 12/2004 | Noguchi | 401/75 |
| 7,044,667 | B2 * | 5/2006 | Tanaka et al. | 401/75 |
| 7,052,198 | B2 * | 5/2006 | Sasaki | 401/75 |
| 7,284,926 | B2 * | 10/2007 | Tanaka et al. | 401/75 |
| 7,455,467 | B2 * | 11/2008 | Sasaki | 401/88 |
| 7,789,581 | B2 * | 9/2010 | Heidenreiter | 401/76 |
| 2007/0147948 | A1 * | 6/2007 | Murakoshi et al. | 401/175 |

FOREIGN PATENT DOCUMENTS

| | | | |
|---|---|---|---|
| DE | 4421609 | A1 | 8/1995 |
| DE | 19630906 | A1 | 2/1998 |
| DE | 10 2005 028 932 | A1 | 1/2007 |
| EP | 0922406 | A1 | 6/1999 |
| EP | 1230868 | A1 | 8/2002 |

* cited by examiner

*Primary Examiner* — David J. Walczak
*Assistant Examiner* — Jennifer C Chiang
(74) *Attorney, Agent, or Firm* — Laurence A. Greenberg; Werner H. Sterner; Ralph E. Locher

(57) ABSTRACT

A rotary pencil includes a sleeve-shaped shaft having a front end and a rear end, a threaded spindle mounted to be fixed against rotation and axially movable in said shaft and having an at least single-start external thread. At least one threaded element is fixed in axial and rotating directions relative to the shaft and engages into the external thread. The front end of the external thread is adjoined by a cylindrical spindle section which extends over the entire circumference of the spindle, namely a free-running section, and has an external diameter corresponding to a core diameter of the external thread.

2 Claims, 20 Drawing Sheets

ROTARY PENCIL

CROSS-REFERENCE TO RELATED APPLICATION

This application claims the priority, under 35 U.S.C. §119, of German Patent Application Nos. DE 10 2009 040 134.2, filed Sep. 4, 2009 and DE 10 2009 055 240.5, filed Dec. 23, 2009; the prior applications are herewith incorporated by reference in their entirety.

BACKGROUND OF THE INVENTION

Field of the Invention

The invention relates to a rotary pencil, in which a lead, for example a cosmetic lead, is fed forward with the aid of a spindle drive. A pencil of that type includes a shaft with a threaded spindle mounted fixedly in terms of rotation and so as to be axially movable therein. The threaded spindle has an at least single-start external thread, i.e. an external thread having only one thread tooth. A lead holder carrying a lead, for example a cosmetic lead, is connected to the front end of the threaded spindle. A threaded element is disposed fixedly in terms of rotation in a sleeve-shaped front part rotatably connected to the shaft and engages into the external thread of the threaded spindle.

During assembly of pencils of that type, an apparatus is used to automatically rotate the threaded spindle and thereby move it into a rear end position, in which it is retracted as far as possible into the shaft. A lead is then inserted into the shaft through a front pencil opening and pushed into the lead holder, which is configured like a bowl or a section of a tube. The automatic rotation of the threaded spindle means that it is not possible, in practice, for the threaded element mentioned above to be situated exactly at the front end of a thread turn or of a thread groove when the threaded spindle is in the end position. For that reason, the front end of the external thread is configured in such a manner that the threaded spindle can continue to be rotated in its rear end position. In one configuration, described further below, the threaded elements are moved radially outward in that case. As is likewise explained in more detail further below, that can result in mechanical impairment of the threaded elements or of a spring element bearing them, which presses the threaded elements into the thread groove with a radial force component.

SUMMARY OF THE INVENTION

It is accordingly an object of the invention to provide a rotary pencil, which overcomes the hereinafore-mentioned disadvantages of the heretofore-known devices of this general type.

With the foregoing and other objects in view there is provided, in accordance with the invention, a rotary pencil, comprising a sleeve-shaped shaft having a front end and a rear end and a threaded spindle mounted to be fixed against rotation and axially movable in the shaft. The threaded spindle has a circumference and an at least single-start external thread with a core diameter. At least one threaded element is fixed in axial and rotary directions relative to the shaft. The at least one threaded element engages into the external thread. A cylindrical spindle section adjoins the front end of the external thread and extends entirely over the circumference of the spindle. The cylindrical spindle section is a free-running section having an external diameter corresponding to the core diameter of the external thread.

Since the threaded element does not change its radial position, this prevents mechanical loading of the threaded element or of a spring element bearing it. This can potentially last for a very long time, depending on when the pencil is used for the first time.

Other features which are considered as characteristic for the invention are set forth in the appended claims.

Although the invention is illustrated and described herein as embodied in a rotary pencil, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
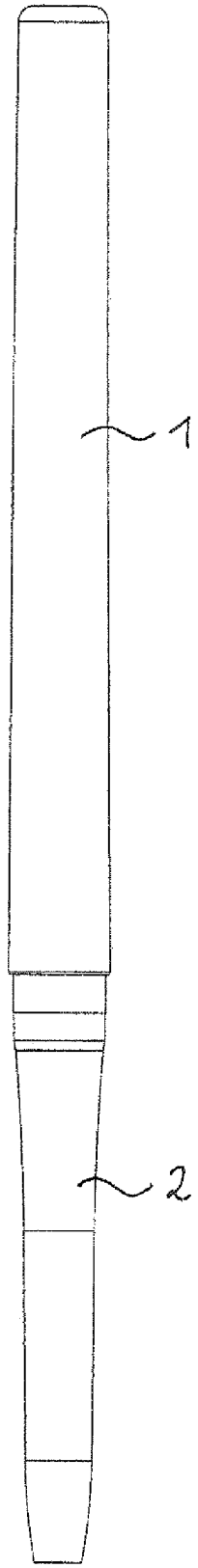
FIG. 1 is a diagrammatic, side-elevational view of a rotary pencil which includes a shaft and a front part.
Figure 2:
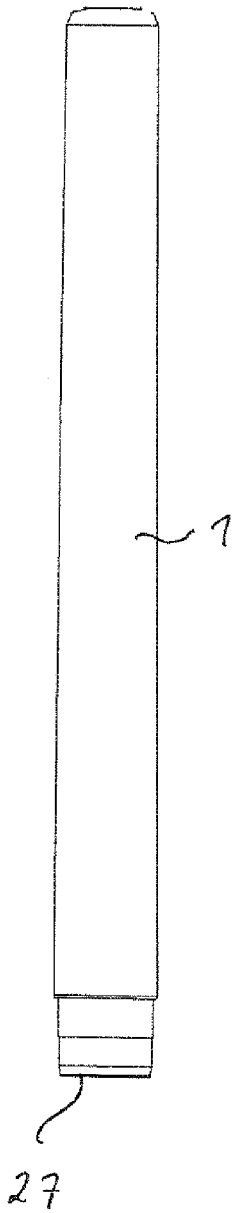
FIG. 2 is a side-elevational view of the shaft.
Figure 3:
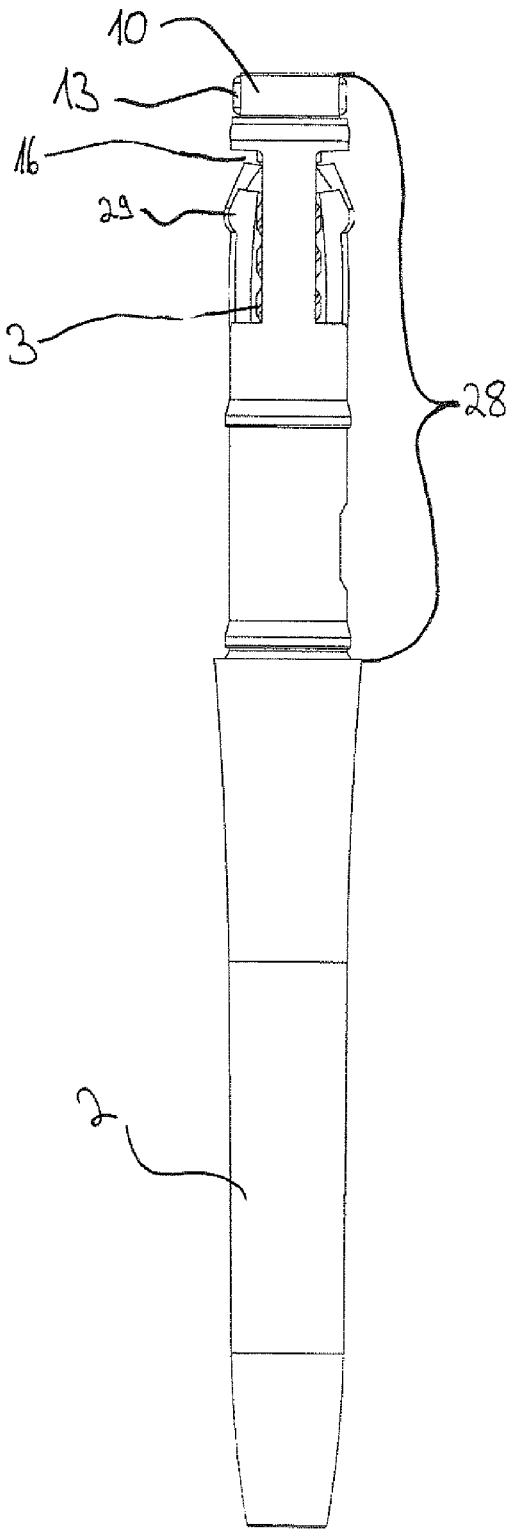
FIG. 3 is a side-elevational view showing the front part with a threaded spindle located therein.
Figure 4:
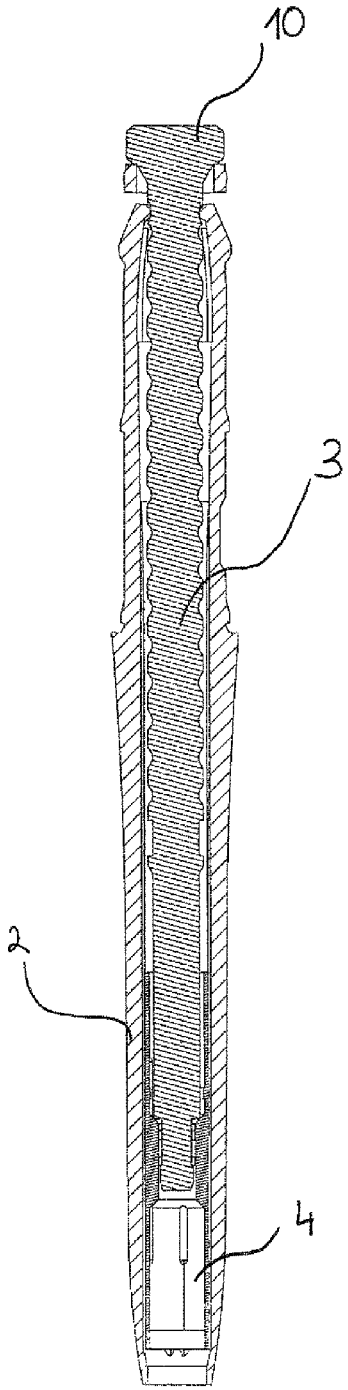
FIG. 4 is a longitudinal-sectional view of the front part, including the threaded spindle.
Figure 5:
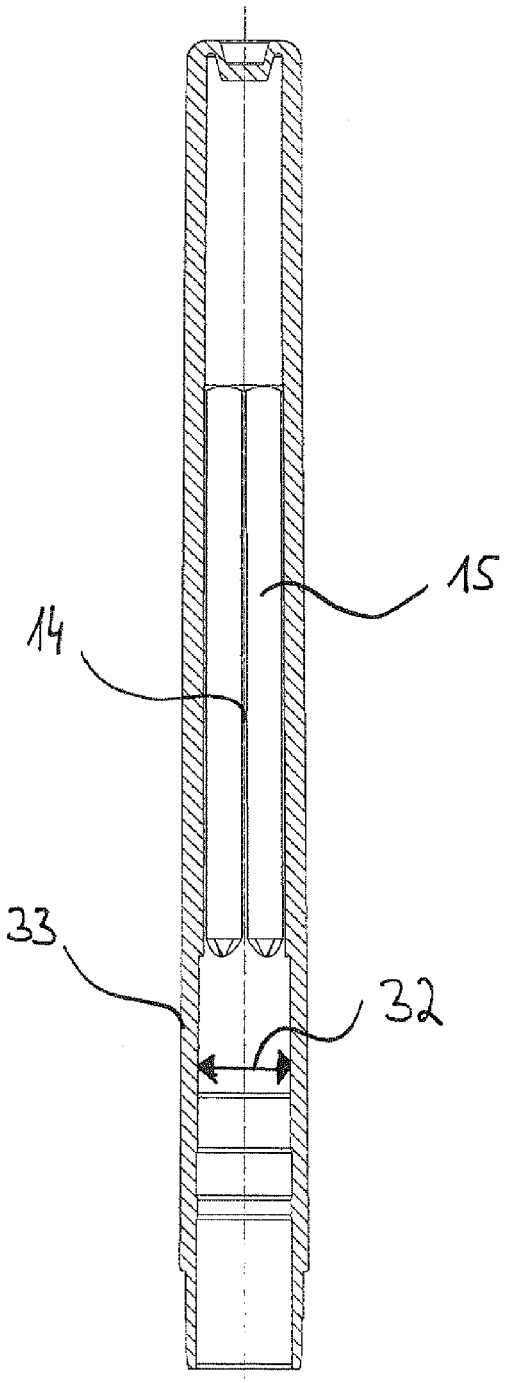
FIG. 5 is a longitudinal-sectional view of the shaft.

Referring now to the figures of the drawings in detail and first, particularly, to FIGS. 1-6 thereof, there is seen a rotary pencil which includes a sleeve-shaped shaft 1, a sleeve-shaped front part 2, a threaded spindle 3 and a lead holder 4. A further component is a closure cap which can be fixed to the front part and protects a lead protruding therefrom, but this closure cap is not explained below and is not shown in the appended figures either. The dimensions of an interior space 5 of the front part 2 in the radial direction are such that the threaded spindle 3 is axially movable together with the lead holder 4, which is rotatably fixed to a journal 11 at the front end of the threaded spindle. The threaded spindle 3 has a front, thread-free section 6 and an adjoining section having a double-start external thread 7. There is an opening 8 for the non-illustrated lead at the front end of the front part 2. The rear end of the threaded spindle 3 is radially widened and is configured in the form of a cylinder section 10. The cylinder section 10 is disposed so as to be axially displaceable in the shaft 1 with a form-locking connection effective in the direction of rotation. By way of example, the form-locking connection is formed by virtue of the fact that two diametrically opposite knobs 13 protrude from the circumferential surface of the cylinder section 10 and protrude into corners 14 (shown in FIG. 5) of a longitudinal section 15, formed with a hexagonal internal cross section, of the shaft 1. A form-locking connection is one which connects two elements together due to the shape of the elements themselves, as opposed to a force-locking connection, which locks the elements together by force external to the elements.

Figure 6:
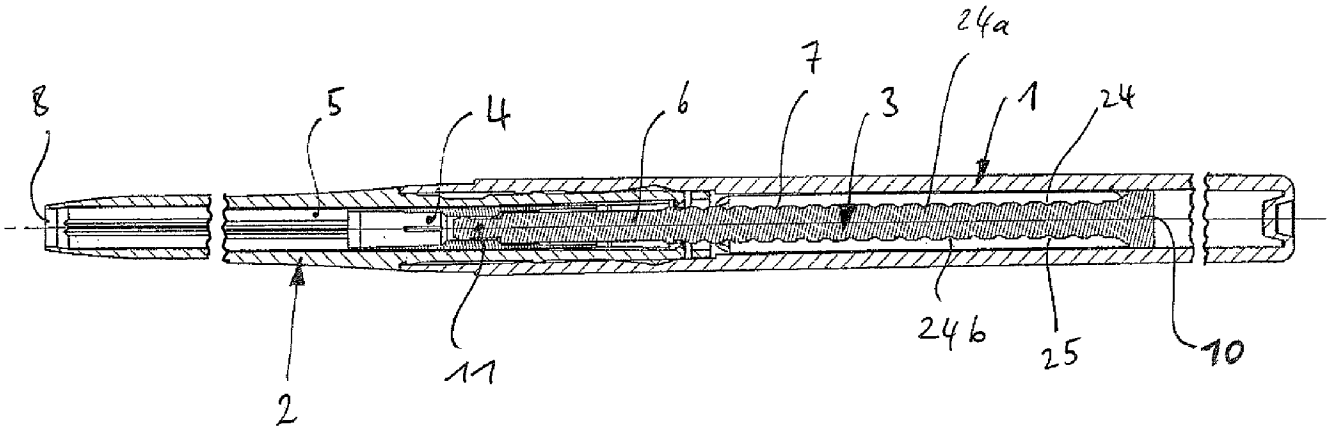
FIG. 6 is a longitudinal-sectional view of the rotary pencil of FIG. 1.
Figure 7:
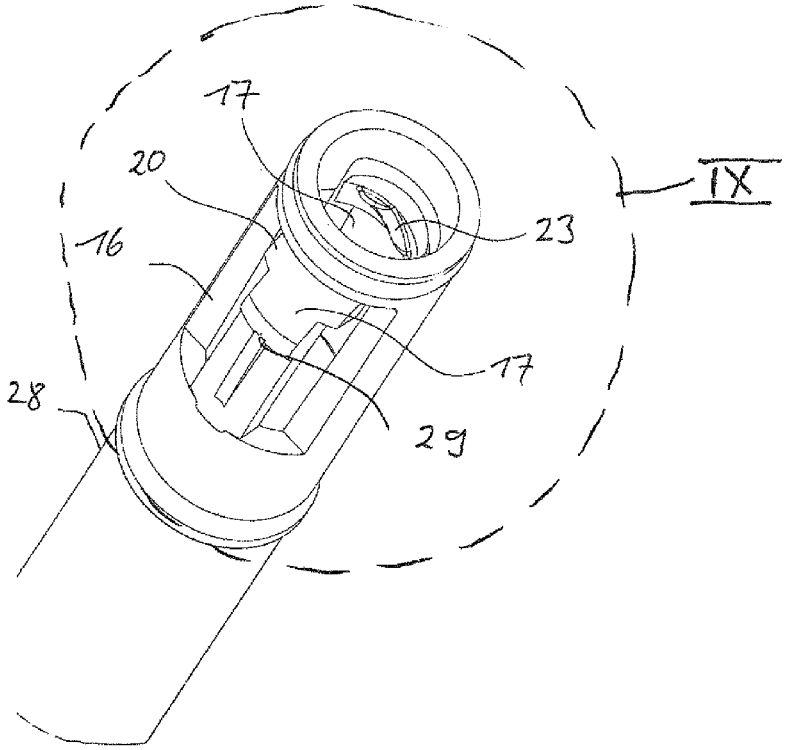
FIG. 7 is an enlarged, fragmentary, perspective view of a rear end of the front part, without the threaded spindle.
Figure 8:
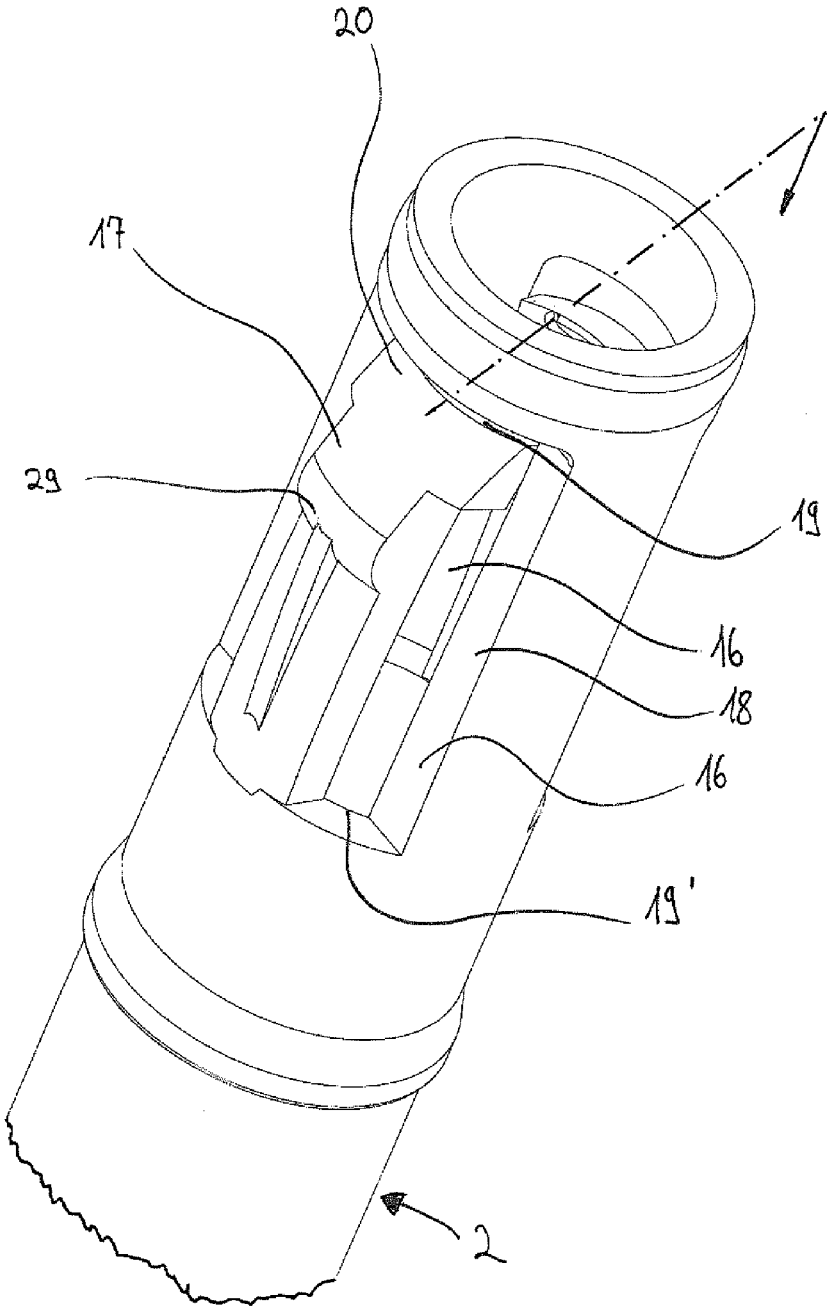
FIG. 8 is a fragmentary, perspective view of the front part of FIG. 7 in another rotary position.
Figure 9:
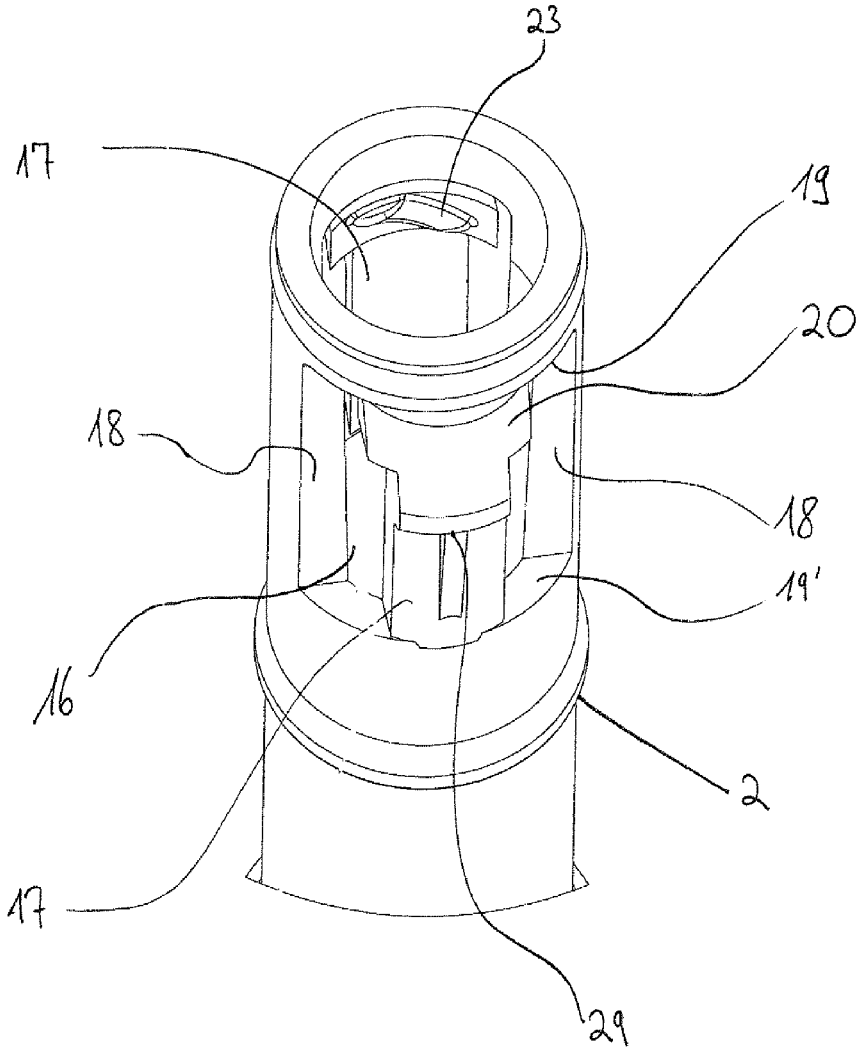
FIG. 9 is a further enlarged, fragmentary, perspective view of a portion IX of FIG. 7.
Figure 10:
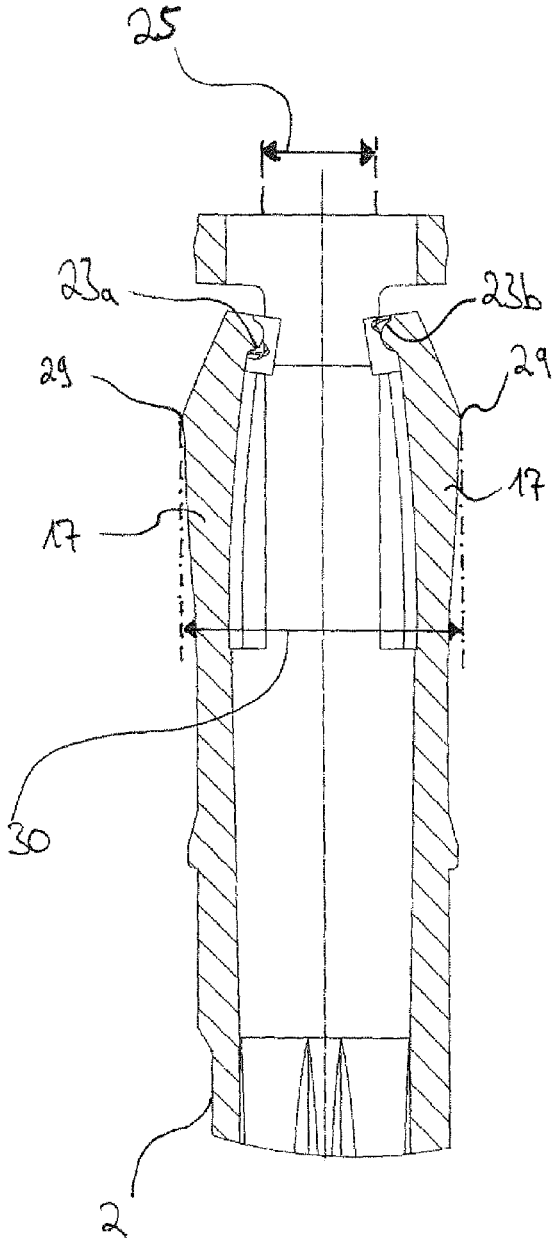
FIG. 10 is a fragmentary, longitudinal-sectional view of the front part, which is taken along a line X-X in FIG. 8.
Figure 11:
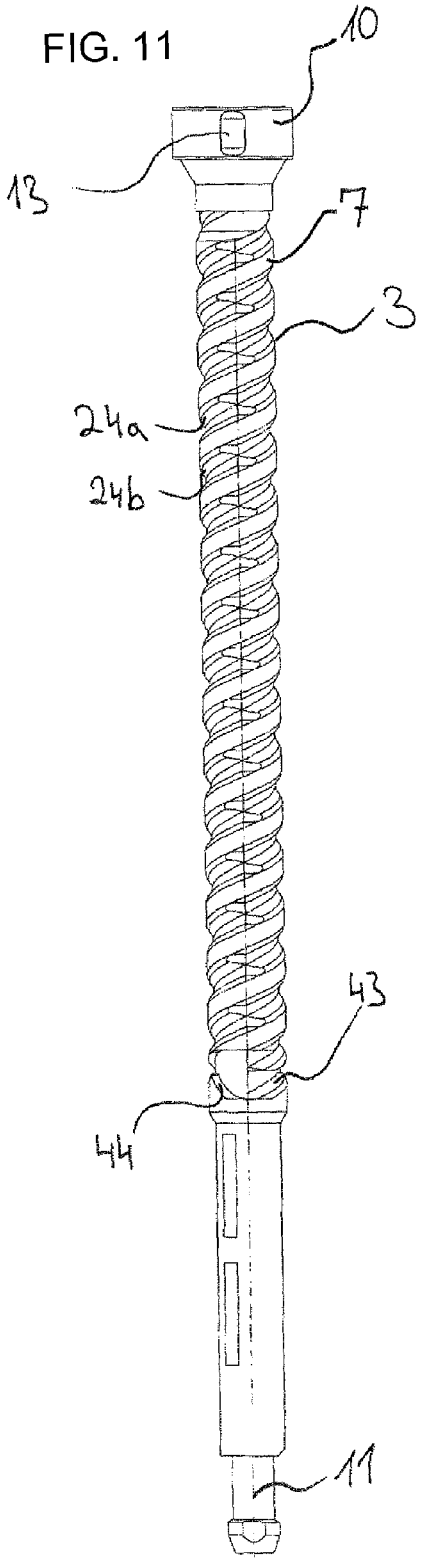
FIG. 11 is a side-elevational view of a threaded spindle.
Figure 12:
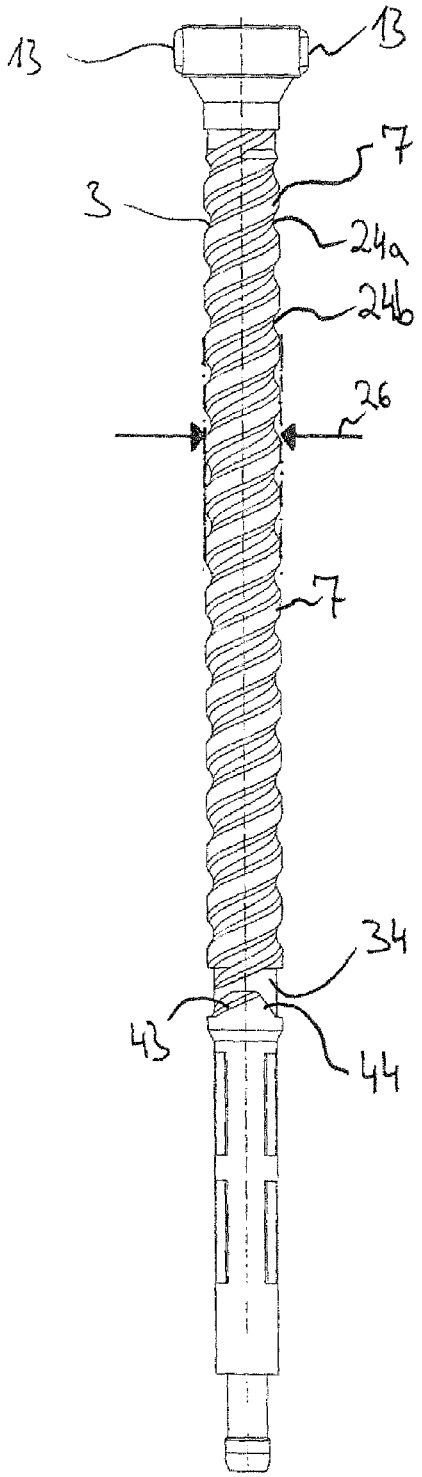
FIG. 12 is a side-elevational view of a threaded spindle in a position rotated through 90° with respect to FIG. 11.
Figure 13:
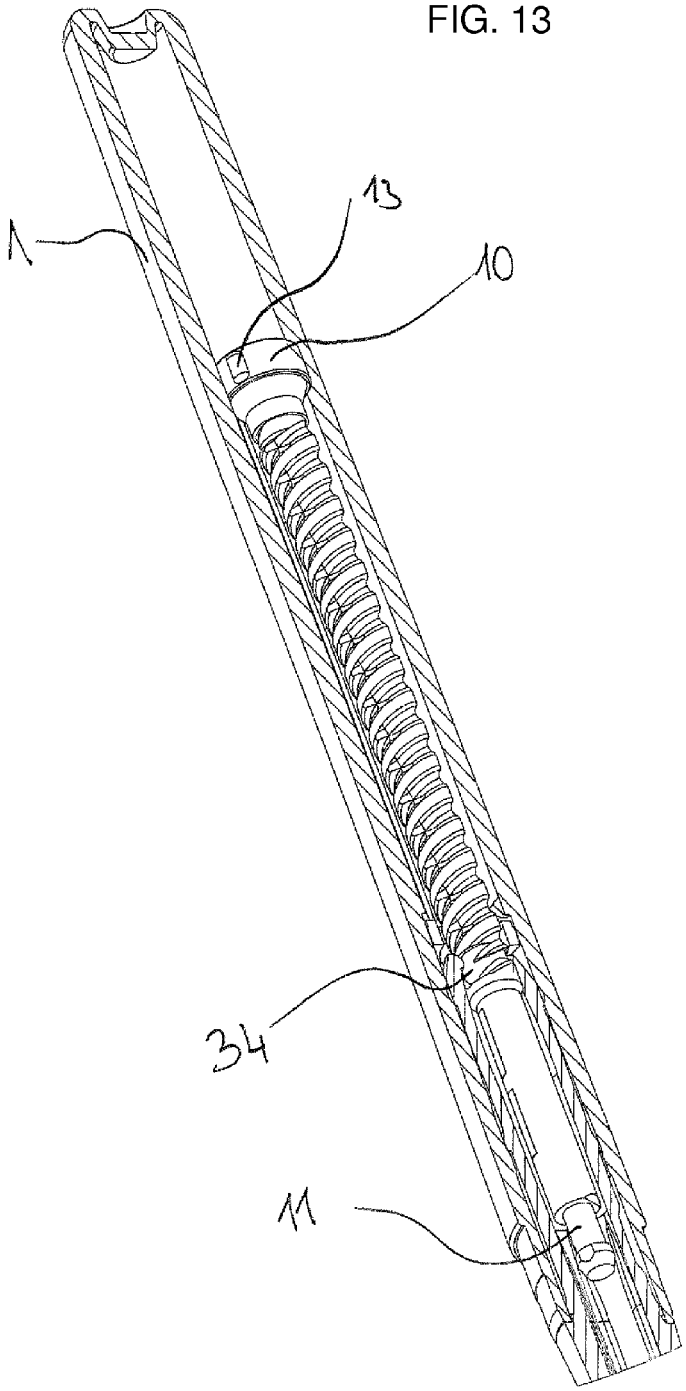
FIG. 13 is a fragmentary, longitudinal-sectional view of a rotary pencil.

As can be gathered, in particular, from the perspective illustrations in FIGS. 7 to 9 and the longitudinal-sectional illustration in FIG. 10, two diametrically opposite windows 16 are present at the rear end of the front part 2. A spring tongue 17 is disposed in each of the windows. The windows 16 each have two edges 18 which run in the axial direction and two edges 19 which run in the circumferential direction. The spring tongues 17 are integrally formed with their base on an edge 19' which is disposed closer to the front end of the front part 2. Free ends 20 of the spring tongues 17 therefore point toward the rear end of the shaft or to the rear. A threaded element 23 is formed integrally on or in one piece with that inner side of each of the free ends 20 which faces toward the threaded spindle 3. This threaded element 23 protrudes radially inward and, when assembled, engages into a first or into a second thread groove 24*a*, 24*b* of the external thread 7 seen in FIG. 6. In a preassembly state shown in FIGS. 7 to 10, the spring tongues 17 are relaxed. A clear width 25 (shown in FIG. 10) between the threaded elements 23 is slightly larger than the largest external diameter of the spindle 3, in particular than an external diameter 26 (shown in FIG. 12) of the external thread 7.

The rotary pencil is largely assembled automatically, wherein the spindle 3 connected to the lead holder 4 is firstly inserted into the front part 2. This is possible without any difficulty due to the dimensional ratios outlined above. By way of example, the spindle 3 can be inserted with the front part 2 oriented perpendicularly, and therefore the spindle moves into its desired position (shown in FIG. 4) by gravity alone. The next assembly step involves pushing a rear section 28 (shown in FIG. 3) of the front part 2, which is equipped with the spindle 3 and the lead holder 4, into the front end 27 (shown in FIG. 2) of the shaft 1. The outer sides of the spring tongues 17 are each provided with a radially outwardly protruding projection 29. A spacing 30 (shown in FIG. 10) or a diameter of a circle which circumscribes the projections 29, is larger than an internal diameter 32 of a shaft section 33 (shown in FIG. 5) which receives the rear end of the front part 2 or the spring tongues 17 thereof and has a cylindrical inner surface. The spring tongues 17 are therefore deflected radially inward when assembled and the threaded elements 23 are thereby pressed into the thread grooves 24*a*, 24*b*.

The next assembly step involves inserting a lead into the bowl-shaped front end of the lead holder 4, wherein an automatic apparatus has been used beforehand to rotate the spindle into its starting position (shown in FIG. 6). This position corresponds to the rear end position of the spindle 3. The problem in this respect is that the automatic apparatus used to twist the front part 2 and the shaft 1 in relation to one another cannot accurately achieve such a rotary position in which the threaded elements 23 are situated at the end of the external thread 7 or at the end of the respective thread grooves 24*a*, 24*b*. It must therefore be ensured that the spindle can continue to rotate in the end position shown in FIG. 6, without threaded elements 23*a*, 23*b* or the spring tongues 17 thereby being damaged.

In the case of a conventional rotary pencil, this is prevented in the manner outlined below: the fundamental construction of the rotary pencil shown in section in FIG. 14 corresponds to that of the rotary pencil outlined above. The front end of a threaded spindle 103 has a cylindrical section 160, into which thread grooves 124*a*, 124*b* extend. As seen in the circumferential direction, the cylindrical section is thereby divided into two sub-regions 161, 162 separated from one another by the thread grooves 124*a*, 124*b*. The cylindrical section 160 is delimited toward the front by a radial shoulder 163, which protrudes radially beyond a circumferential surface 138 thereof and extends over the entire circumference of the section 160. An external diameter 164 of the cylindrical section 160 is larger than a core diameter 137 of an external thread 107 and smaller than an external diameter 126 thereof. If, during the assembly of the pencil, the spindle 103 or a shaft 101 is rotated in relation to a front part 102 or spring tongues 117 in the direction of an arrow I, i.e. counter to the thread-direction of the right-handed external thread 107, the spindle 103 is moved back axially in the direction of an arrow II, until threaded elements 123 rest on the radial shoulder 163. If the spindle 103 is rotated further in the direction I, the threaded elements 123 are moved out of the thread grooves 124*a*, 124*b*, which have a lesser depth in the cylindrical section 160 than in the further external thread 107, and therefore these elements then act on the sub-regions 161, 162, which are parts of a cylinder casing. In this case, the spring tongues 117 are deflected radially outward by a distance corresponding to a difference D between the external diameter 164 of the cylindrical section 160 and the core diameter 137 of the external thread 107, for instance as indicated by arrows 39 in FIG. 14.

Figure 14:
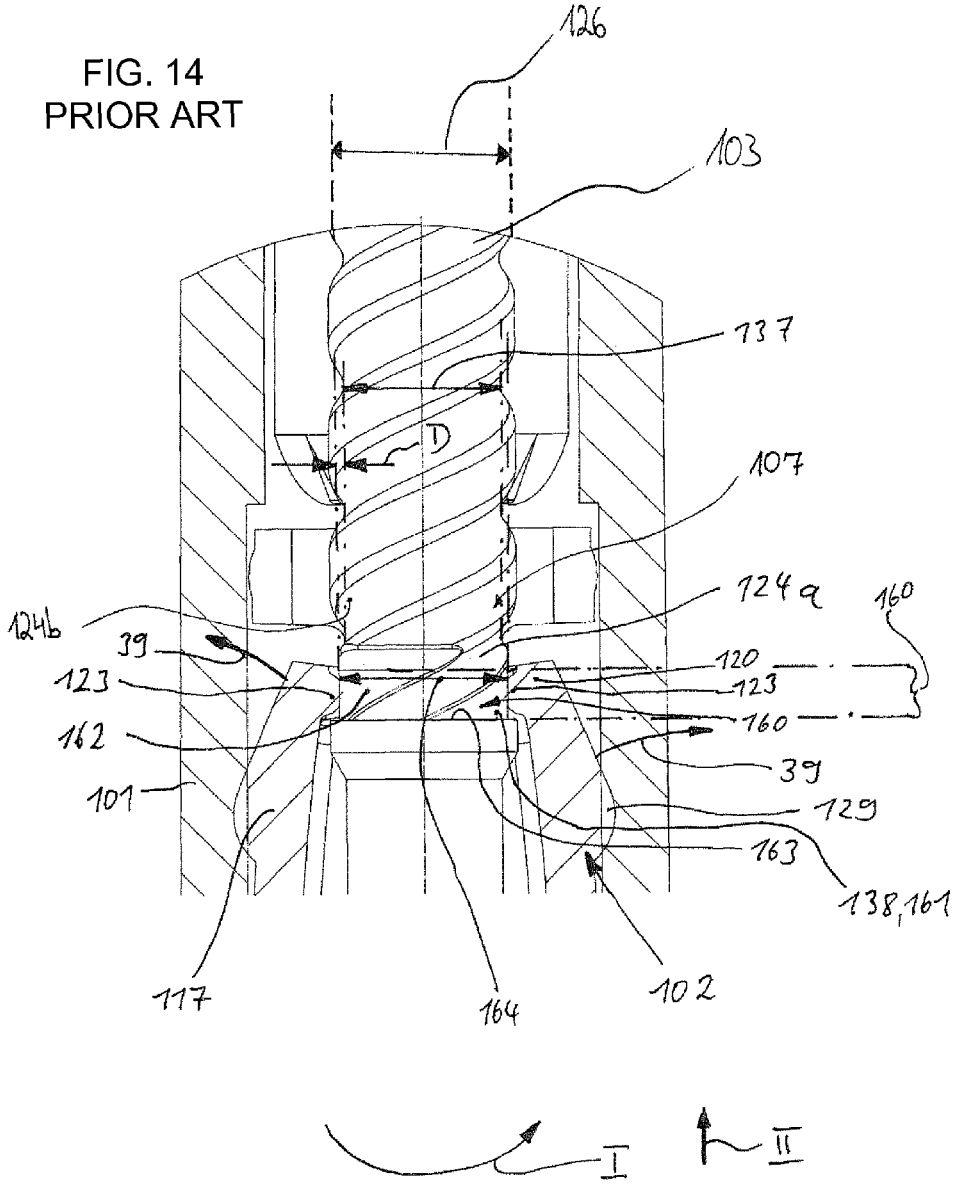
FIG. 14 PRIOR ART
FIG. 14 is an even further enlarged, fragmentary, longitudinal-sectional view of a rotary pencil according to the prior art.

During the potentially long period of time between assembly of the rotary pencil and the first use thereof, the spring tongues 117 remain in the position shown in FIG. 14, in which at least their free ends 120, which bear the threaded elements 123, are subjected to a bending stress due to the radially outwardly directed deflection. Particularly at relatively high temperatures of about 40° C. and more, in the case of plastics, for example ABS, which are suitable for the production of rotary pencils of the type in question, this has the effect that the material of the spring tongues 117 experiences a certain amount of fatigue as a result of so-called cold flow. As a result, the threaded elements 123 are pressed into the thread grooves 124*a*, 124*b* with a reduced force during use. If the lead then adheres to the inner side of the front part 102, as may be the case when the rotary pencil is used, in particular, at relatively high ambient temperatures, increased feed forces are needed to overcome the adhesion. However, due to the weakening of the material outlined above, in that case the threaded elements 123 are no longer held with the necessary force in the end regions of the thread grooves 124*a*, 124*b* which extend into the cylindrical section 160, and therefore those threaded elements jump out of the thread grooves and thereby make feeding of the lead impossible.

Figure 15:
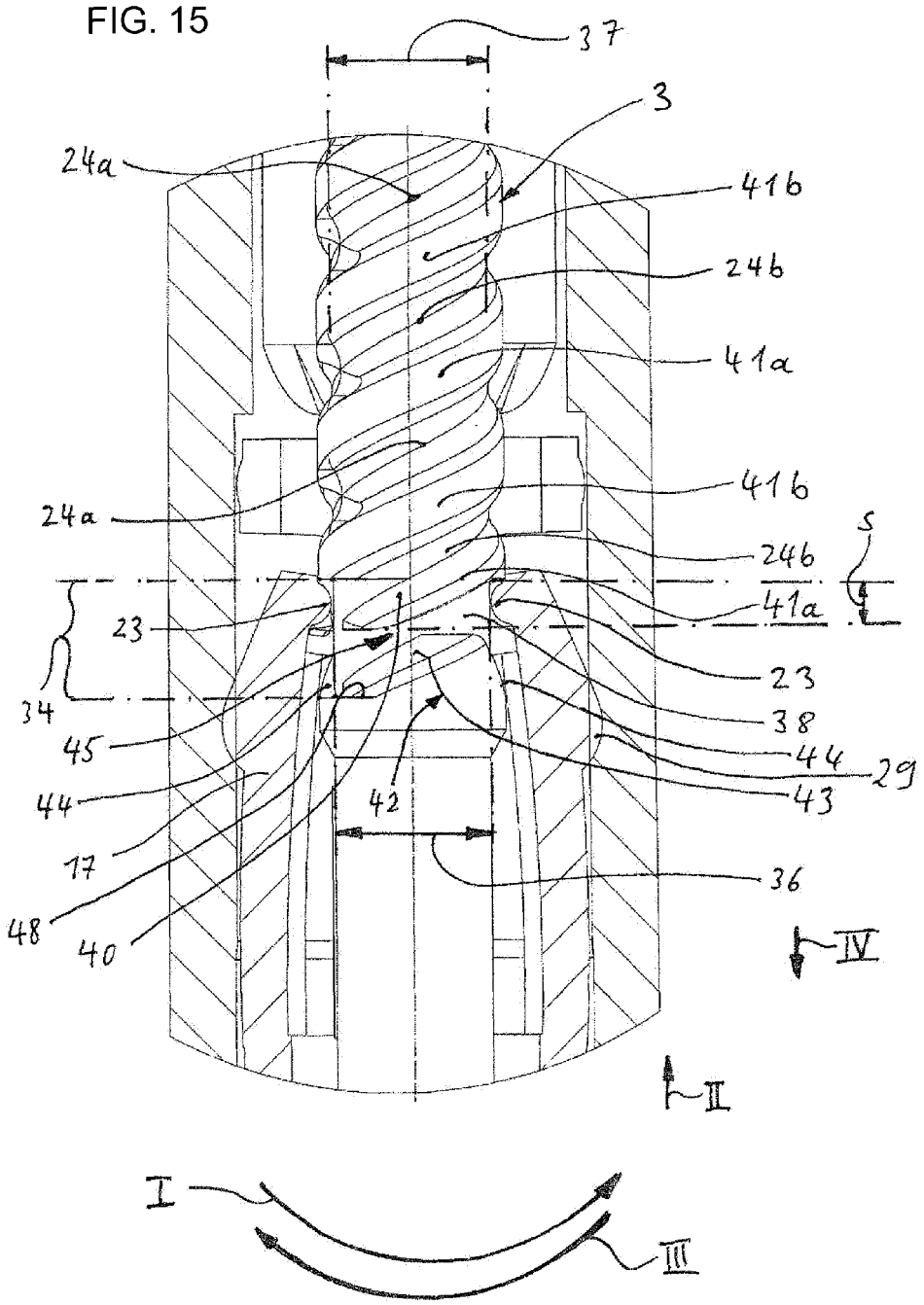
FIG. 15 is a fragmentary, longitudinal-sectional view of a portion XV of FIG. 13.
Figure 16:
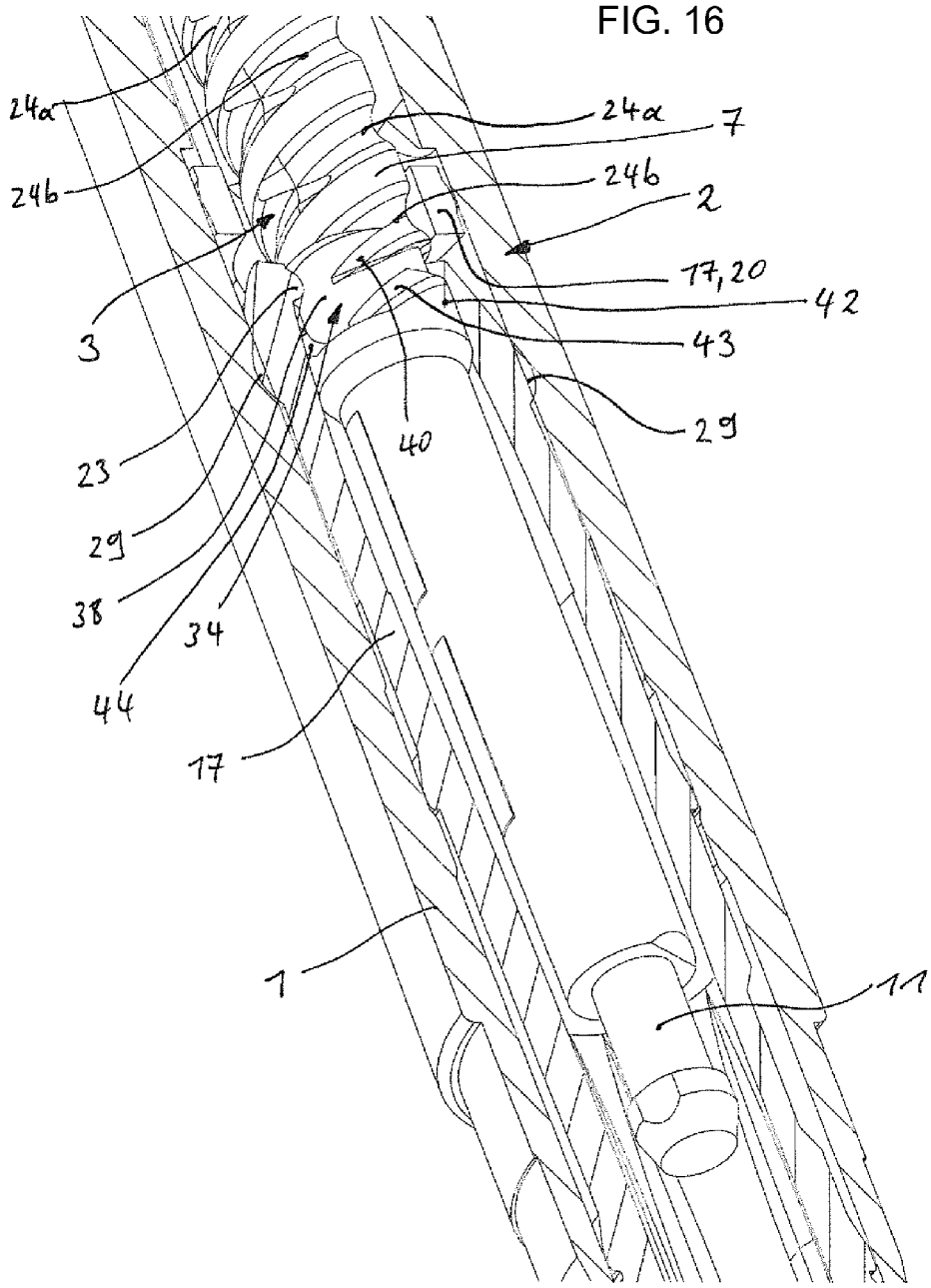
FIG. 16 is a view similar to FIG. 15, in which the threaded spindle assumes a different rotary position.
Figure 17:
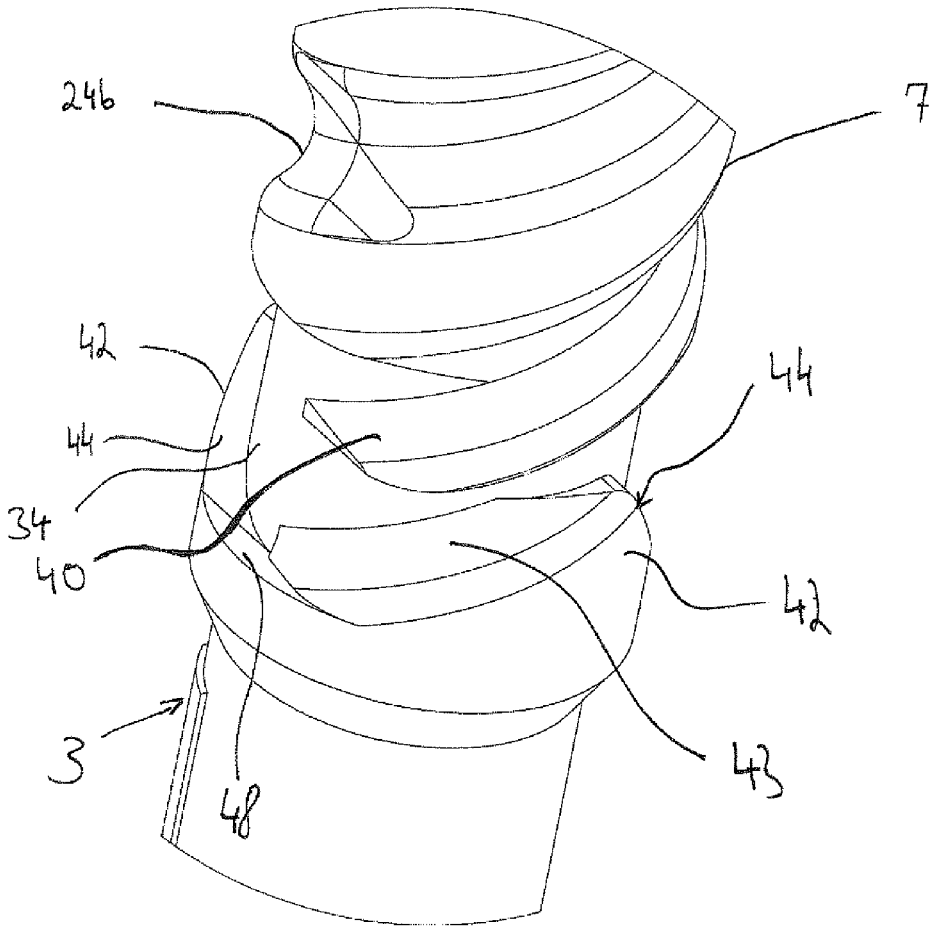
FIG. 17 is a fragmentary, perspective view of a region of the threaded spindle shown in FIG. 15 in a first rotary position.
Figure 18:
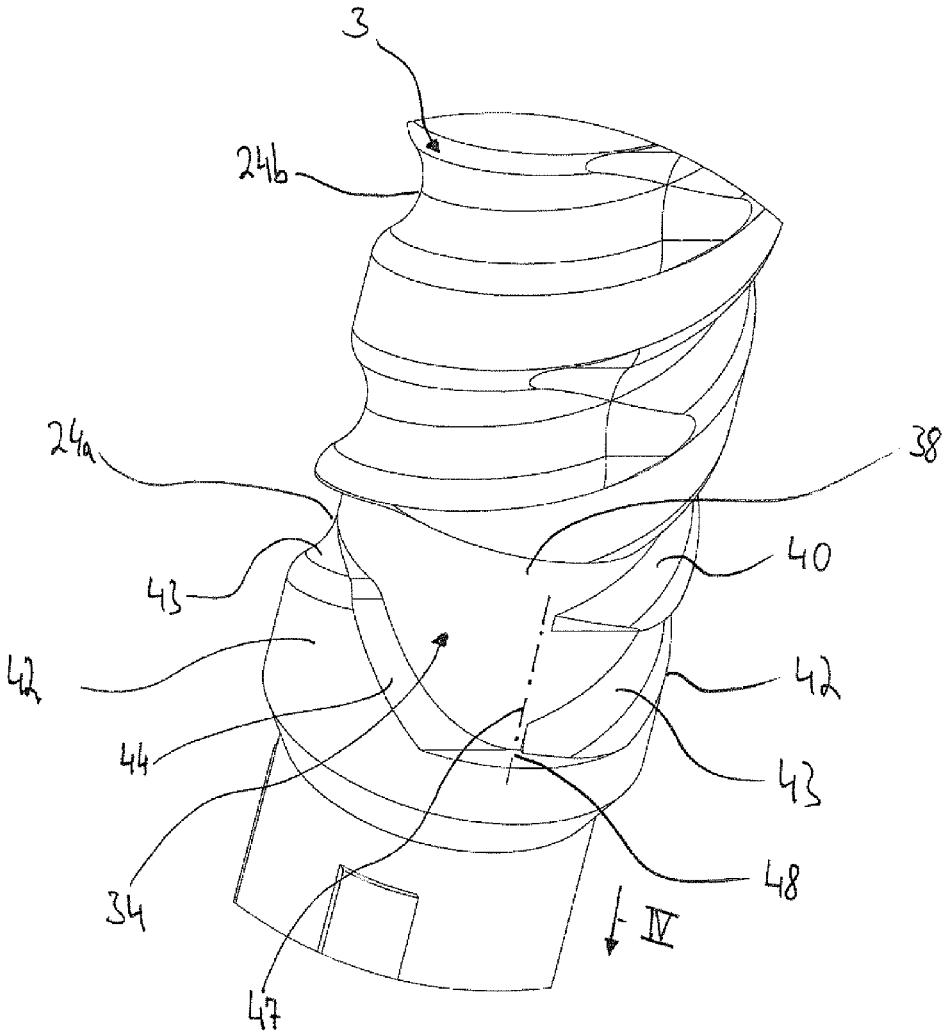
FIG. 18 is a fragmentary, perspective view of the threaded spindle of FIG. 17 in a second rotary position.

In the case of a rotary pencil according to the invention, this is prevented by the following configuration: as can be seen, in particular, in FIG. 15, the spindle 3 of the rotary pencil according to the invention likewise has a cylindrical section, a free-running section 34. The circumferential surface thereof is fully part of a cylinder casing, i.e. it has no thread grooves. The free-running section 34 adjoins the end of the external thread 7, extending over the entire circumference of the spindle. Upon rotation in the direction of an arrow I, the threaded spindle is moved axially in the direction of an arrow II toward the rear end of the pencil, with the threaded elements 23 finally moving up to the circumferential surface of the free-running section 34. In this case, a significant difference from the prior art described above is that an external diameter 36 of the free-running section 34 corresponds to the core diameter 37 of the external thread 7, i.e. the two diameters are either identical or the difference between the diameters is so small that radial widening of the spring tongues 17 in the direction of the arrows 39 in FIG. 14 is small, and therefore the effect of fatigue outlined in relation to the prior art does not arise or is negligible. In the rear end position according to FIG. 15, the spring arms 17 are therefore in a state of stress which corresponds to the state in which they are used, and therefore fatigue phenomena resulting from cold flow, for instance, cannot arise. Even if they are stored for a long time at elevated temperatures of 40° C. and more, the spring tongues 17 are therefore held in the thread grooves 24*a*, 24*b* with a practically unchanged, radially inwardly directed force. Since the free-running section extends over the entire circumference of the spindle, the automatic twisting of the threaded spindle for moving the latter into its rear end position can be ended in any rotary position of the threaded spindle, to be precise with the radial position of the threaded elements 23 being retained.

In order to make it possible to feed lead forward proceeding from the rear end position of the threaded spindle 3, the threaded spindle has to be moved so far forward (in the direction of an arrow IV) that the threaded elements 23 can move into the thread grooves 24*a*, 24*b* when they are rotated to the right (in the direction of an arrow III). In the case of a rotary pencil of the type according to the invention, this is brought about in the following way: an end section 40 of a thread tooth 41*a*, 41*b* extends into the free-running section 34. There are two control cams 42, which are wedge-shaped as seen in a view from the side (in FIG. 15), within the free-running section 34 (in the case of a single-start thread, one control cam would suffice). The control cams 42 each merge at their base into a connection section 48 which extends in the circumferential direction and protrudes from the circumferential surface of the free-running section 34 in the manner of a radial shoulder. The control cams 42 are assigned in each case to an end section 40 of a thread tooth 41*a*, 41*b* and protrude from the circumferential surface of the free-running section 34. The control cams have, in each case interacting with a threaded element 23, a first run-on slope 43, which runs in the thread direction of the external thread 7, and a second run-on slope 44, which runs counter to the thread direction. Thread direction is to be understood as meaning that direction of rotation of a thread in which the thread rotates into a thread interacting with it. In the case of a right-handed thread, the thread teeth or the thread grooves rise to the right, as seen in a view from the side of the thread. A groove 45 which runs in the thread direction of the external thread 7 remains uncovered between the first run-on slope 43 and the end section 40 of a thread tooth 41*a*, 41*b*. The groove is dimensioned in such a way that a threaded element 23 fits through it. The control cams 42 extend in the axial direction toward the end section 40 at least until there is an axial spacing 46 (seen in FIG. 19) between them and the end section 40 which is smaller than an axial dimension 47 (seen in FIG. 20) of the threaded elements 23.

Figure 19:
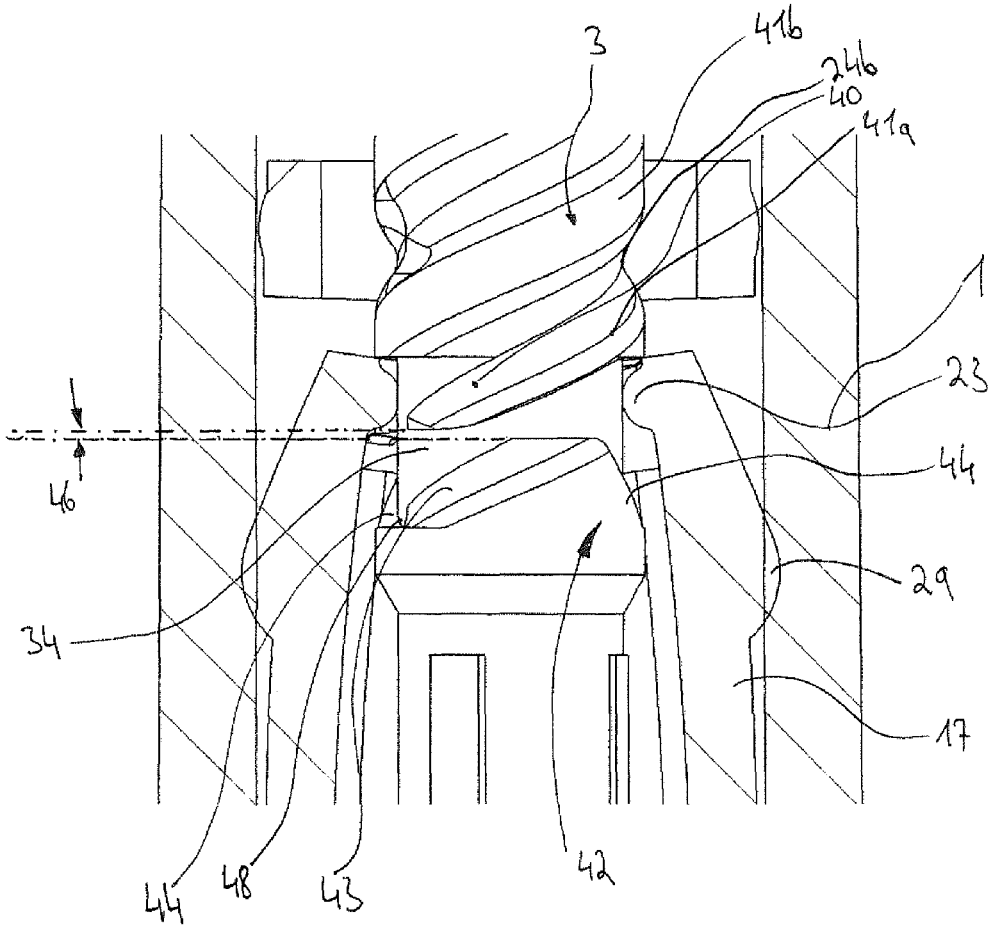
FIG. 19 is a fragmentary, longitudinal-sectional view of an enlarged portion of FIG. 15.
Figure 20:
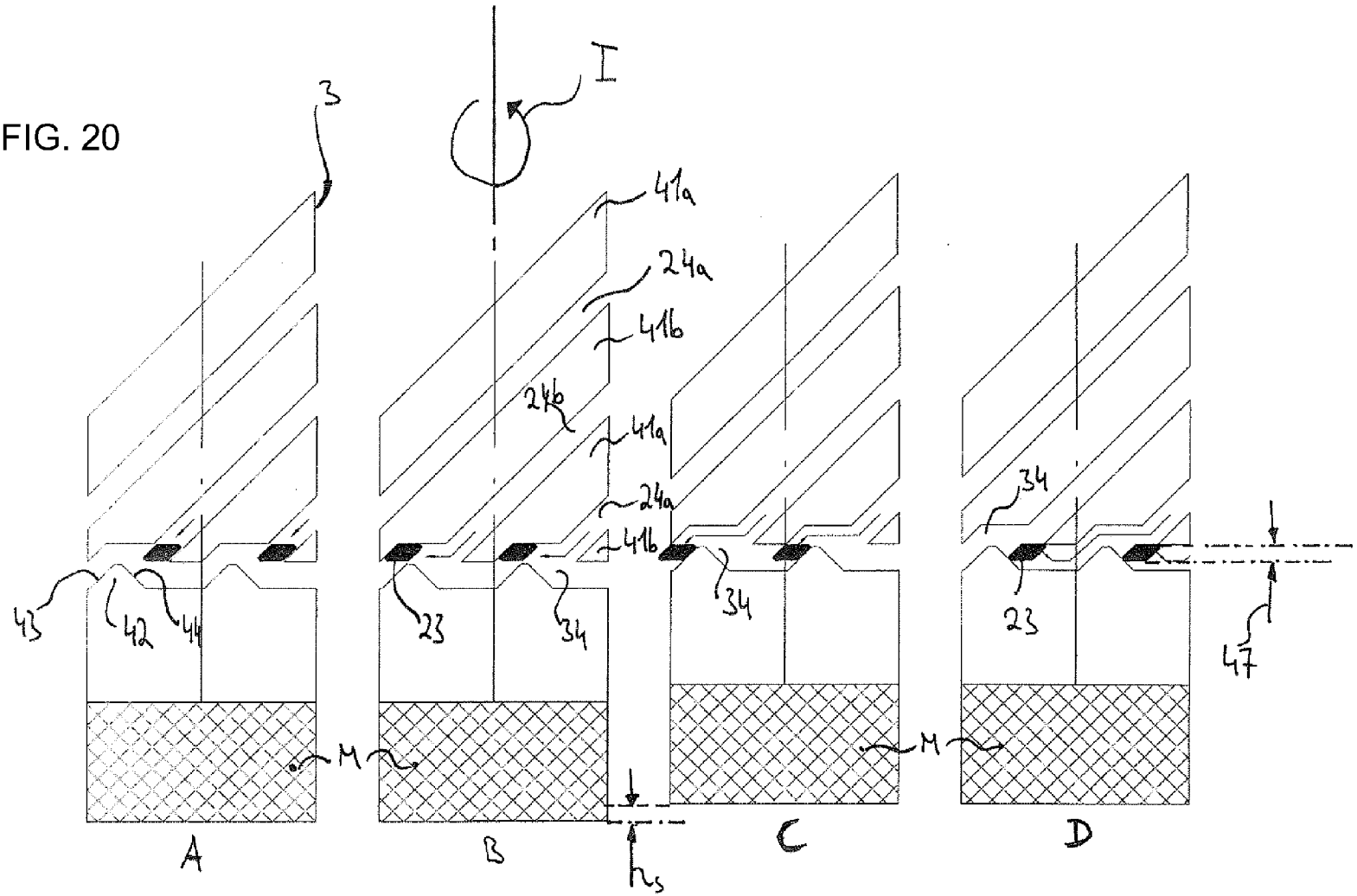
FIGS. 20 and 21 are developed views of the threaded region shown in FIG. 19, which show the mode of operation of the threaded spindle or of the rotary pencil.
Figure 21:
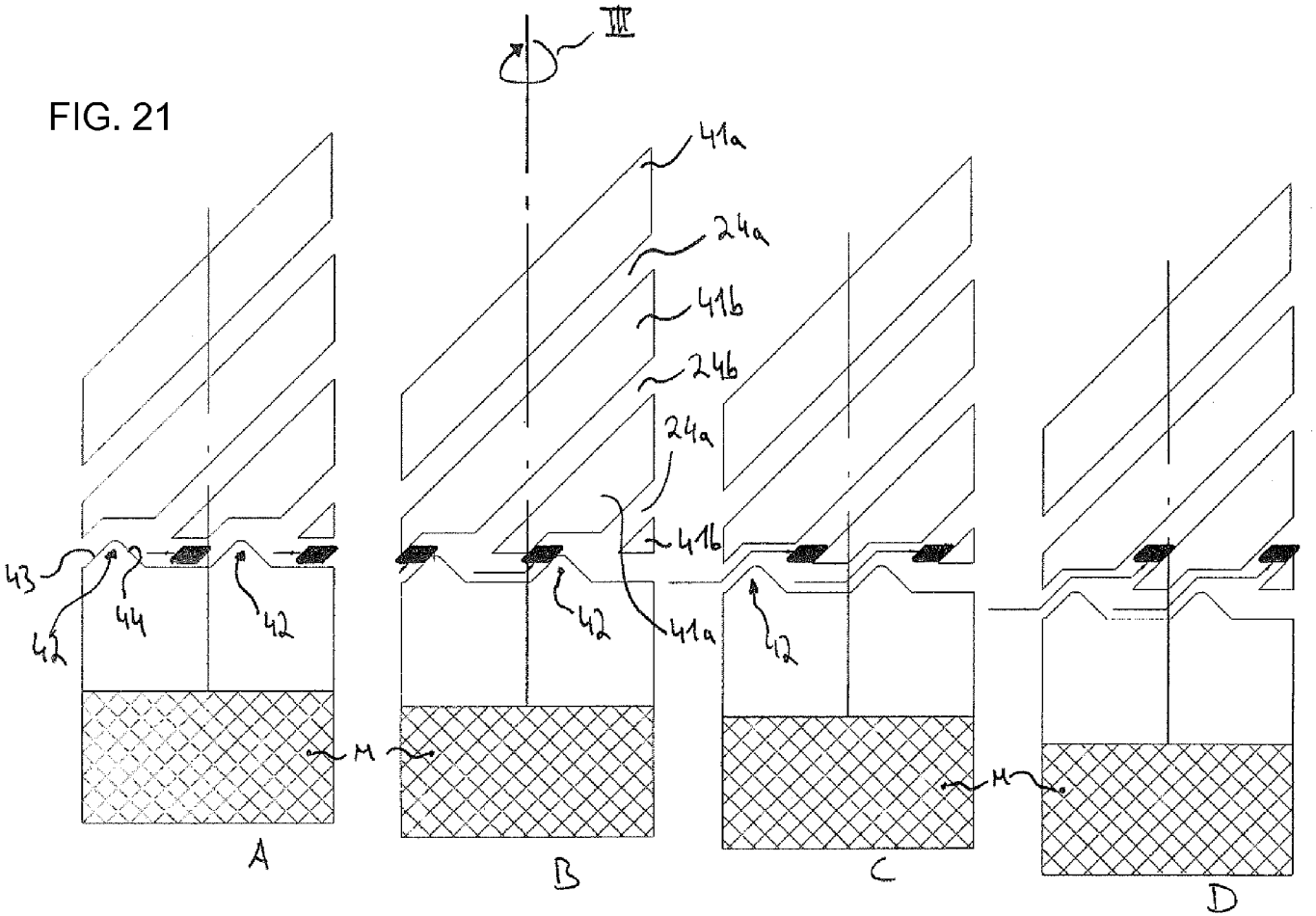

The mode of operation of the configuration described above will now be explained while also making reference to the diagrammatic illustrations according to FIGS. 20 and 21, which show developed views of a threaded spindle with lead M fixed thereto: in the situation shown in FIGS. 15 and 19, a non-illustrated automatic apparatus has been used to move the threaded spindle 3 by rotation to the left (the arrow I) so far into the shaft 1 that the spindle is located just in front of its rear end position, in which a lead can be pushed into the lead holder 4. The threaded elements 23 of the spring tongues 17 are already located within the free-running section 34 and act on the circumferential surface 38 thereof. If, proceeding from the situation shown, the threaded spindle 3 is rotated further to the left, it will be moved forward by a distance s by interaction of the end sections 40 with the threaded elements 23. In the process, the threaded elements 23 reach into the groove 45 present between the end section 40 and the first run-on slope 43 (see also FIG. 20 A to C). If the threaded spindle 3 continues to be rotated to the left, the end sections 40 pass the threaded elements 23 (FIG. 20 C and D), until finally the second run-on slopes 44 strike against the respective threaded elements 23 (FIG. 20 D). The consequence of this is an axial forward movement in the direction of the arrow IV, until the situation shown in FIG. 20 B is reached again. If the threaded spindle 3 continues to be rotated to the left, the latter therefore performs an axial pendulum movement between the positions according to FIG. 20 B and D with the amplitude s.

When the rotary pencil is used for the first time, the threaded spindle 3 is made to rotate to the right with respect to the threaded elements 23 (FIG. 21) by reciprocal twisting of the shaft 1 and the front part 2. Proceeding from a situation shown in FIG. 20 C or D, the control cams 42 move up to the threaded elements 23 with their first run-on slope 43, as a result of which the threaded spindle 3 is displaced in the feed direction or in the direction of the arrow IV in FIG. 15. In the process, the threaded elements 23 perform a relative oblique movement along the groove 45 located between an end section 40 of a thread tooth 41*a*, 41*b* and the first run-on slope 43. The threaded elements 23 are then in an axial position relative to the threaded spindle 3 in which they can be captured by the end section 40 of the other respective thread tooth 41*a*, 41*b* disposed diametrically opposite on the free-running section 34. In order for this to be possible, a control cam 42 has to extend toward an end section 40 at least until there is an axial spacing 46 between the latter and the control cam which is smaller than the axial dimension 47 (FIG. 20 D) of the threaded element 23.

The invention claimed is:

1. A rotary pencil, comprising:

a sleeve-shaped shaft having a front end and a rear end;

a threaded spindle mounted to be fixed against rotation and axially movable in said shaft, said threaded spindle having a core cross-sectional area and an at least single-start external thread with a core diameter and a front end;

at least one threaded element being fixed in axial and rotary directions relative to said shaft, said at least one threaded element being spring-mounted into engagement with said external thread;

a cylindrical spindle section adjoining said front end of said external thread and having a cross-sectional area extending entirely over said core cross-sectional area of said spindle, said cylindrical spindle section being a free-running section having an external diameter corresponding to said core diameter of said external thread;

a thread tooth having an end section extending into said free-running section; and a control cam, being wedge-shaped as seen from a side of said threaded spindle, protruding from a circumferential surface of said the free-running section, and disposed at an axial spacing from said end section;

said control cam having a first run-on slope running in a thread direction of said external thread and a second run-on slope running counter to said thread direction;

said external thread having a groove receiving said threaded element, running in said thread direction of said external thread and remaining uncovered between said first run-on slope and said end section;

said control cam extending in axial direction toward said end section at least until forming an axial spacing between said control cam and said end section being smaller than an axial dimension of said threaded element.

2. The rotary pencil according to claim 1, wherein said threaded spindle is a double-start threaded spindle, said thread tooth is one of two thread teeth each having an end section, and said control cam is one of two control cams each being associated with a respective one of said end sections.

* * * * *